United States Patent [19]

Alonso

[11] Patent Number: 4,871,133

[45] Date of Patent: Oct. 3, 1989

[54] KITE BRIDLE AND METHOD

[75] Inventor: Frank Alonso, Pacoima, Calif.

[73] Assignee: Llumar Star Kites, Inc., Pacoima, Calif.

[21] Appl. No.: 77,416

[22] Filed: Jul. 24, 1987

[51] Int. Cl.[4] ..... B64C 31/06

[52] U.S. Cl. ..... 244/153 R; 244/155 A; 24/DIG. 11; 248/205.3

[58] Field of Search ..... 244/153 R, 153 A, 158 R, 244/155 A, 154; 24/DIG. 11; 248/467, 74.3, 205.3; 403/209

[56] References Cited

U.S. PATENT DOCUMENTS

| | | | |
|---|---|---|---|
| 1,400,735 | 12/1921 | Eddy | 244/154 |
| 1,494,453 | 5/1924 | Wanner | 244/153 R |
| 2,519,594 | 8/1950 | Ohland | 244/153 R |
| 2,769,605 | 11/1956 | Sparkman | 244/153 R |
| 2,893,068 | 7/1959 | Johnson et al. | 24/DIG. 11 |
| 3,162,920 | 12/1964 | Durham | 24/DIG. 11 |
| 3,193,235 | 7/1965 | Jensen | 244/DIG. 11 |
| 3,334,736 | 8/1967 | Cole et al. | 248/205.3 |
| 3,697,023 | 10/1972 | Jackson | 244/153 R |
| 3,799,106 | 3/1974 | Lanpouf | 248/205.3 |
| 4,018,407 | 4/1977 | Aber | 244/153 R |
| 4,150,804 | 4/1979 | Jackson | 244/153 R |
| 4,286,762 | 9/1981 | Prouty | 244/155 A |

*Primary Examiner*—Galen L. Barefoot
*Attorney, Agent, or Firm*—Louis Bachand

[57] ABSTRACT

The problem of shifting of the bridle connection to the frame members in a stunt kite which impairs control is obviated by a quickly assemblable anchor means which comprises a fold-over tab which adheres to itself and to the member about which it is folded and provides an opening to which the bridle may be tied.

11 Claims, 1 Drawing Sheet

KITE BRIDLE AND METHOD

TECHNICAL FIELD

This invention has to do with kite apparatus and more particularly with improved means for attachment of bridles to apparatus of the stunt kite type.

BACKGROUND

Stunt kites are becoming increasingly popular. In this type of kite flying, two control lines are used, and the bridle has two control loops which are connected at the top to opposite sides of the kite center, so that the kite is highly maneuverable by alternating force on the control lines. Once the domain of the kite enthusiast who enjoyed the difficulty of mastering the intricacies of flying loops, dives and whirls, stunt kite flying now appeals to a much broader spectrum of people. In the past it has been the common practice to attach the bridle control loops to the cross member in two places and in one place on the vertical member of the frame through holes in the kite sail. The mode of attachment has been wrapping and tying of the kite string forming the bridle loops onto the frame members. In addition to being an awkward method of assembling the kite, with the increasing use of plastic frame members, the knots and wraps of the bridle tend to slide along the members misaligning the bridle and when aggravated enough, impairing control of the kite movements and reducing the pleasure of kite flying. The sail holes do not act effectively to constrain this movement.

SUMMARY OF THE INVENTION

It is accordingly an object of the invention to provide an improved manner of attaching bridles to stunt kites. It is another object to provide such a mode of attachment in which the bridle loops are positively affixed to the frame members against sliding out of the desired position. It is a still further object to provide a method of assembling a kite using the improved anchoring means of the invention to secure the bridle immovably in desired position.

These and other objects of the invention, to become apparent hereinafter, are realized by the provision in a kite apparatus having a frame comprising a vertical member and a cross member, and a sail distributively attached to the frame members, a bridle comprising a control loop for attachment to a kite control line held by the kite flier, the control loop having its lower and upper end attached to the kite frame, of the improvement comprising a pair of control loop end anchor means opposite respectively the loop lower and upper ends, the anchor means each comprising a flexible web adhered to the frame and defining an attachment means for the control loop ends, whereby the loop upper and lower ends are fixed relative to the kite frame against control-impairing shifting along the frame during flying of the kite.

In particular embodiments: the anchor means defines an opening into which the loop can be tied in anchored relation; the anchor means web comprises a synthetic organic plastic or cellulosic film; the anchor means web is folded on itself in cohered relation about a frame member; and/or the anchor means web is glued to the member.

In a more particularly preferred embodiment, there is provided in accordance with the invention, a stunt kite apparatus having a frame comprising a plastic vertical member and a plastic cross member, a plastic sail attached by its corners to the frame members, a bridle comprising first and second control loops for separate attachment to kite control lines held by the kite flier, the control loops being upwardly divergent and having respective lower ends adapted to be attached to the kite frame vertical member, and relatively spaced upper ends respectively adapted to be attached to the cross member, control loop upper end anchor means on the cross member opposite respectively the loop upper ends and on the vertical member opposite the control loop lower ends, the anchor means each comprising a flexible web adhered to the cross member and defining an attachment means for the control loop upper end to the respective frame members, whereby the loop upper and lower ends are fixed relative to the kite frame members against control-impairing shifting along the frame members during flying of the kite.

In this as in other embodiments, typically:the anchor means defines an opening in which the loop can be tied in anchored relation; the anchor means web comprises a synthetic organic plastic or cellulosic film; the anchor means web is folded on itself in cohered relation about the cross member; and the anchor means web is glued to the cross member.

In a highly particularly preferred embodiment, there is provided a stunt kite apparatus having a cruciform frame comprising a plastic vertical member and a plastic cross member, a plastic sail attached by its corners to the frame members, a string bridle comprising first and second control loops for separate attachment to kite control lines held by the kite flier, the control loops being upwardly divergent and having respective lower ends adapted to be attached to the kite frame vertical member, and relatively spaced upper ends respectively adapted to be attached to the cross member, control loop upper end anchor means on the cross member opposite respectively the loop upper ends and on the vertical member opposite the control loop lower ends, the anchor means each comprising a generally circular flexible plastic web folded on itself over the cross member or vertical member respectively and adhered to itself and the members, the web defining cantilevered from the members a closed opening through which the string bridle loop is passable in tying relayion for attachment of the control loop upper ends and lower ends to the respective frame members, whereby the loop upper and lower ends are fixed relative to the kite frame members against control-impairing shifting thereof along the frame members during flying of the kite.

In accordance with the method aspects of the invention there is provided the method of assembling a dual control stunt kite kite, including aligning a frame cross member on a frame vertical member, attaching a sail to the frame members, affixing to the frame members in a bridle supporting pattern a plurality of bridle anchoring means comprising adherent tabs defining immovable bridle attachment means on the members, and thereafter attaching the bridle to the tabs, the tabs being preferably folded upon themselves around the members and glued to themselves and to the members, thereby to affix the tabs to the members.

THE DRAWING

The invention will be further described as to an illustrative embodiment in conjunction with the attached drawing in which.

PREFERRED MODES

Figure 1:
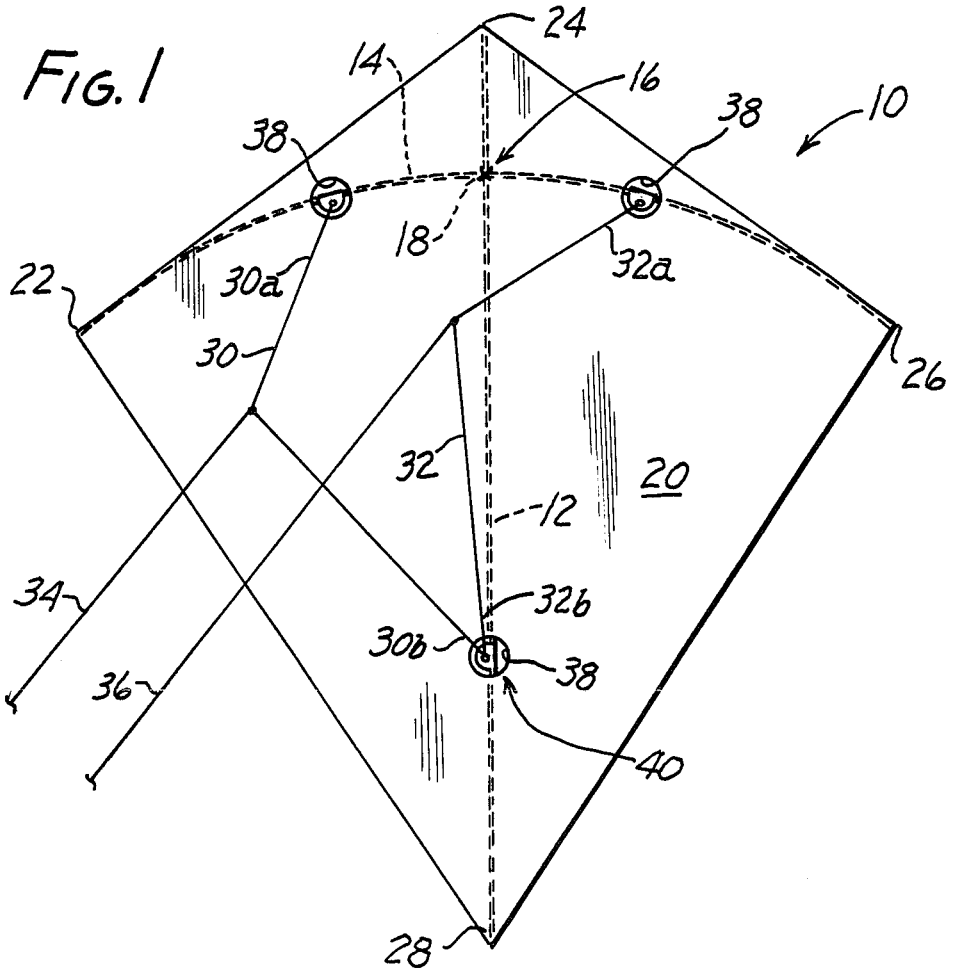
FIG. 1 is a top plan view of the assembled kite apparatus.

With reference to the drawing in detail, in FIG. 1 the kite 10 is a stunt kite and comprises a frame having a vertical member 12 and a cross member 14 which intersect at 16 where they are joined by a suitable fastener 18. The members 12 and 14 are typically plastic rods, such as polypropylene. The kite sail is indicated at 20 and comprises a plastic or cellulosic sheet material suitably shaped, as in the diamond shape as shown, and distributively secured at its corners 22, 24, 26 and 28 to the frame members 12, 14. The kite 10 is provided with a bridle arrangement comprising left and right hand upwardly divergent control loops 30, 32, each comprising a length of kite string secured at its upper end **30*a*, 32*a* to the cross member 14 and at its lower end 30*b*, 32*b* to the vertical member 12. Left and right hand control lines 34, 36 are separately connected to the respective left and right control loops 30, 32, for purposes of manuevering the kite 10 through acrobatic stunts. Thusfar described the kite 10** is conventional.

The conventional mode of attachment of the upper and lower ends **30*a*, 30*b*, 32*a*, 32*b* of the control loops 30, 32 has been to knot the ends to the frame members 12, 14, through the openings 38 in the sail 20, which are placed at strategic locations for proper positioning of the bridle control loops. The difficulty has been that in addition to being awkward to tie to, the members 12, 14 are usually slippery and the string of the loops does not get a good purchase and consequently slips. The sail openings 38** are too large and the sail itself too flimsy to control slipping movement of the control loop ends, and as a result the left to right and the vertical positioning of the loops varies unpredictably with consequent decrease in degree of control.

Figure 2:
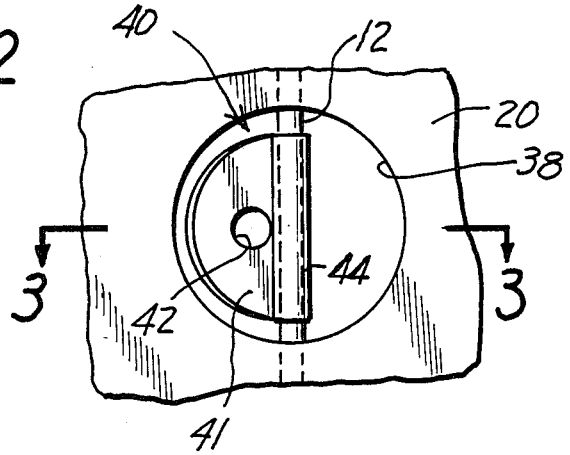
FIG. 2 is a detail view, greatly enlarged, of the bridle attachment tabs.
Figure 3:
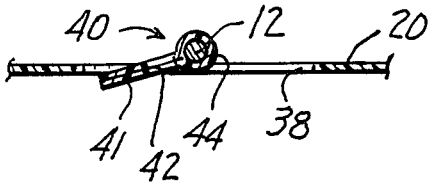
FIG. 3 is a view in section taken in line 3—3 in FIG. 2.

This problem is solved by the present invention wherein positive affixation of the control loop ends is achieved and the kite assembled in a facile manner. With specific reference to FIGS. 2 and 3, the anchoring tab 40 of the invention is depicted. The tab 40 comprises a suitably circular, although any configuration will do, web 41 of any durable material of adequate strength, such as high strength plastic sheet, woven natural and synthetic goods, and combinations of these. The tab 40 defines an opening 42 through which the string of the control loop 30 or 32 is passed for tying to the tab. Conveniently the tab 40 is such that it can be folded on itself with registration of opposed apertures to define the opening 42, giving double wall strength to the opening and cantilevering the opening beyond the fold 44 of the tab. The tab 40 is suitably self-adhesive, or is separately provided with glue such that upon being placed about the member 12 or 14 the tab walls are pressed to one another and against the member itself in gluing relation, to affix the tab in the desired position. Once in place the tab 40 is immovable unless peeled apart by main force. The locations of the control loop 30, 32 ends is thus determined initially and throughout flight of the kite 10. Other physical arrangements of tabs may be used such as anchor shapes, provided the tab affords anchorage for the control loop string and is affixable to the member to which the control loop is to be connected.

The present method of assembling the kite 20 thus includes attachment of the control loop ends, **30*a*, 32*a*, 30*b*, 32*b* to respective sites at which the tabs 40** have been placed, in lieu of direct connection to the members which support the tabs. In this way the bridle defined by the control loops remains in place during flight and is easy to properly assemble.

The foregoing objects are thus met.

I claim:

1. In a kite apparatus having a frame comprising a vertical member and a cross member, and a sail distributively attached to said frame members, a bridle comprising a control loop for attachment to a kite control line held by the kite flier, said control loop having lower and upper ends attached to said kite frame, the improvement comprising a pair of control loop end anchor means opposite respectively said loop lower and upper ends, said anchor means each comprising a self-adhesive flexible web having opposed openings and wrapped upon itself so that said openings are in registration and said web is adhered to said frame whereby said registered tab openings define an attachment means for said control loop ends wherein said loop upper and lower ends are fixed relative to said kite frame against control-impairing shifting along said frame during flying of the kite.

2. Kite apparatus according to claim 1, in which said anchor means defines an opening into which said loop can be tied in anchored relation.

3. Kite apparatus according to claim 1, in which said anchor means web comprises a synthetic organic plastic or cellulosic film.

4. A stunt kite apparatus having a frame comprising a plastic vertical member and a plastic cross member, a plastic sail attached by its corners to said frame members, a bridle comprising first and second control loops for separate attachment to kite control lines held by the kite flier, said control loops being upwardly divergent and having respective lower ends adapted to be attached to said kite frame vertical member, and relatively spaced upper ends respectively adapted to be attached to said cross member, control loop upper end anchor means on said cross member opposite respectively said loop upper ends and on said vertical member opposite said control loop lower ends, said anchor means each comprising a flexible web having opposed openings and wrapped upon itself so that said openings are in registration and said web is adhered to said cross member whereby said registered tab openings define an attachment means for said control loop upper end to said respective frame members, wherein said loop upper and lower ends are fixed relative to said kite frame members against control-impairing shifting along said frame members during flying of the kite.

5. Stunt kite apparatus according to claim 4, in which said anchor means defines an opening in which said loop can be tied in anchored relation.

6. Stunt kite apparatus according to claim 5, in which said anchor means web comprises a synthetic organic plastic or cellulosic film.

7. Stunt kite apparatus according to claim 6, in which said anchor means web is folded on itself in cohered relation about said cross member.

8. Stunt kite apparatus according to claim 7, in which said anchor means web is glued to said cross member.

9. A stunt kite apparatus having a cruciform frame comprising a plastic vertical member and a plastic cross member, a plastic sail attached by its corners to said frame members, a string bridle comprising first and second control loops for separate attachment to kite control lines held by the kite flier, said control loops being upwardly divergent and having respective lower ends adapted to be attached to said kite frame vertical member, and relatively spaced upper ends respectively adapted to be attached to said cross member, control loop upper end anchor means on said cross member opposite respectively said loop upper ends and on said vertical member opposite said control loop lower ends, said anchor means each comprising a generally circular flexible plastic web folded on itself over said cross member or vertical member respectively and adhered to itself and to said members, said web defining cantilevered from said members a closed opening through which said string bridle loop is passable in tying relation for attachment of said control loop upper ends and lower ends to said respective frame members, whereby said loop upper and lower ends are fixed relative to said kite frame members against control-impairing shifting thereof along said frame members during flying of the kite.

10. Method of assembling a dual control stunt kite, including aligning a frame cross member on a frame vertical member, attaching a sail to said frame members, folding a generally circular flexible plastic web having registerable apertures on itself over said members and adhering said tab to itself and to said members to affix to said frame members in a bridle supporting pattern a plurality of said tabs in bridle anchoring relation to define immovable bridle attachment means on said members by said tab apertures, and thereafter attaching a bridle to said tabs at said apertures.

11. The method according to claim 10, including also folding said tabs upon themselves around said members and gluing to themselves and to said members, thereby to affix said tabs to said members.

* * * * *